United States Patent [19]

Ballas

[11] 4,077,333

[45] Mar. 7, 1978

[54] ADJUSTABLE TABLE

[76] Inventor: George C. Ballas, 10515 Harwin Dr., Houston, Tex. 77036

[21] Appl. No.: 788,155

[22] Filed: Apr. 18, 1977

[51] Int. Cl.[2] ..... A47F 5/12

[52] U.S. Cl. ..... 108/6; 312/231; 312/281

[58] Field of Search ..... 108/6, 1; 312/281, 231; 248/384, 371, 406, 418; 211/150; 188/72.1, 71.1

[56] References Cited

U.S. PATENT DOCUMENTS

| | | | |
|---|---|---|---|
| 617,324 | 1/1899 | Earl, Jr. | 108/142 |
| 1,401,960 | 1/1922 | Child | 108/142 |
| 1,409,257 | 3/1922 | Staley | 108/142 |
| 1,564,358 | 12/1925 | Klein | 108/6 |
| 1,589,198 | 6/1926 | McComb | 211/150 |
| 3,435,783 | 4/1969 | Kollenborn | 108/142 |

FOREIGN PATENT DOCUMENTS

| | | | |
|---|---|---|---|
| 652,025 | 3/1929 | France | 108/6 |
| 599,734 | 11/1959 | Italy | 108/6 |

*Primary Examiner*—James T. McCall

*Attorney, Agent, or Firm*—Bard, Springs, Jackson & Groves

[57] ABSTRACT

An adjustable table is provided for use with a hospital bed and which allows a person reclining in the bed to easily change the angle of inclination of the table surface. The planar member is rotatably connected at one end to and extended horizontally outward from a vertical support member by means of frictionally engaged gripping elements. Lifting up on the free end of the planar member disengages the gripping elements whereby the planar member can thereafter be freely tilted or rotated about its longitudinal axis to a selected angle of inclination. Lowering the free end of the planar member to its original position re-engages the gripping elements to fix the planar member at the selected angle of inclination.

10 Claims, 5 Drawing Figures

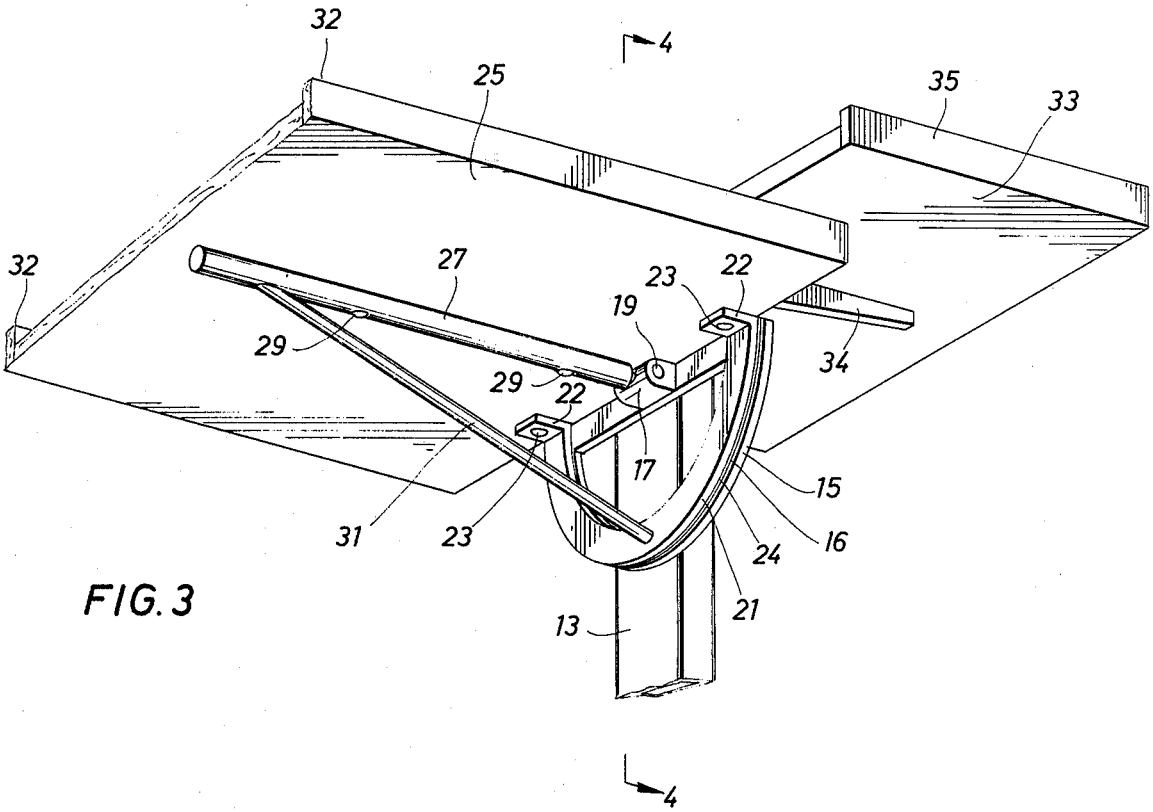
FIG. 3
FIG. 4
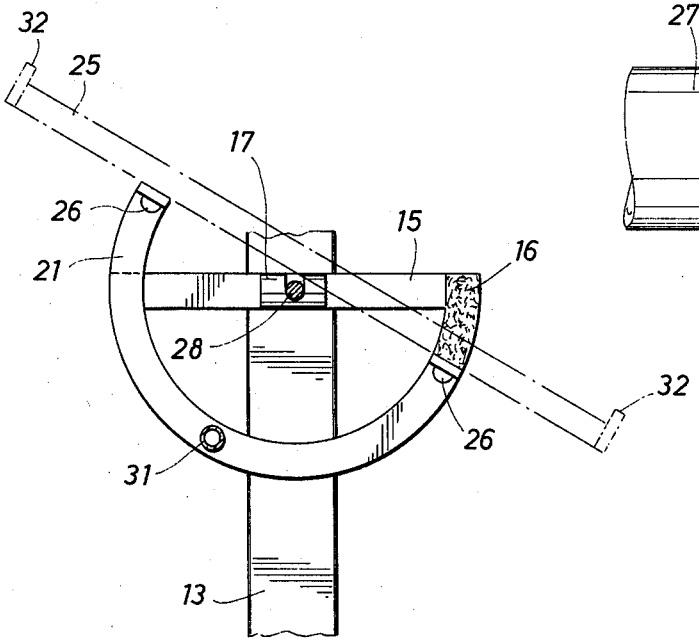
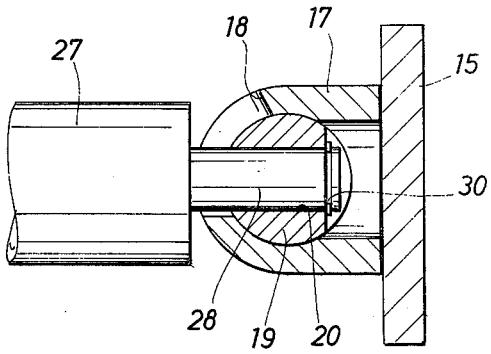
FIG. 5

ADJUSTABLE TABLE

BACKGROUND OF THE INVENTION

The present invention relates to an adjustable table and more particularly to a table which may be adjusted to any desired height, angle or inclination or positioned in any horizontal direction.

The subject invention is designed primarily for use by bed-ridden patients and permits the performance of many tasks by a recumbent or semi-recumbent person which tasks have heretofore been extremely difficult if not impossible under such conditions. In addition, such device has proven to be especially practical for persons aggravated by back and/or neck strain resulting from long hours of standing or sitting. It has been shown that such a person utilizing the subject adjustable table while working in an incumbent position can actually increase work output, primarily due to the added comfort and relaxation afforded.

Some of the many tasks that can be performed from a horizontal or semi-recumbent position are as follows: typing can be easily and comfortably executed; many business machines such as adding machines, posting machines and calculators can easily and quickly be secured to the table and utilized; heavy books may conveniently be supported; and drawing and oil painting may easily be performed. Additionally, the table may conveniently be used as a desk, a drafting table, a work bench, a display board, an easel, a hospital table and/or desk or as a utility table.

Furthermore, the novel adjustable table makes available to the user many pieces of furniture that would not ordinarily be used in the home but whose occasional would be beneficial, as for example, a typewriter stand, a drafting table or a hospital table. The cost of these separate pieces of furniture would be prohibitive and their space requirements do not ordinarily justify their individual purchase.

The subject invention is designed for convertibility, mobility, adaptability and portability and provides many useful functions both indoors and outdoors, in home and office, hospitals and rest homes and schools and institutions.

The prior art is prolix with attempts at solutions to provide adjustable tables designed primarily for use by bed-ridden patients and which permit the performance of many tasks of recumbent or semi-recumbent persons. In addition, such devices have proven to be especially practical for persons aggravated by back and/or neck strain resulting from long hours of standing or sitting. It has been shown that such persons utilizing an adjustable table while working in an incumbent position can actually increase work output, primarily due to the comfort and relaxation afforded.

Attempts have been made to provide such adjustable tables and, in general, have used one of three means for securing the table surfaces at the desired angle of inclination. One such means includes a pair of arcuate members defining a central groove in each member. A pair of stud bolts are connected to the table and positioned to ride in the grooves, allowing the table to be inclined about the horizontal axis. When the desired angle of inclination is reached, wing nuts, threaded onto the stud bolts and positioned against the arcuate members, retain the table member at the desired angle.

A second means generally found in drafting tables, includes a locking mechanism interconnected to the axial support member of the table surface. A hand or foot lever is interconnected to the locking means and is positionable to disengage the locking means, whereby the axial support member is free to rotate and the table may be inclined to the desired angle. The lever is repositioned to engage the locking mechanism to maintain the table at the selected inclination.

The third means includes a plate member, laying in a plane normal to the horizontal axis of the table, cooperating with frictional elements positioned therearound to provide a frictional force for maintaining the table at a pre-set angle of inclination. To change to inclination, sufficient rotational forces must be exerted against the table to overcome the frictional force of the elements bearing on the plate.

The disadvantage of the prior adjustable table tilting devices is the difficulty of manipulating the various securing devices by a reclining person.

The first mentioned device requires that the user be able to reach the securing wing nuts situated at either extremity, a location normally beyond the rear of a reclinating person. Further, the wind nuts tend to "back-off" during use, requiring periodic re-tightening.

The second mentioned device is a complex, precision-made mechanism. Such mechanisms levy a requirement for periodic maintenance and adjustment. Additionally is it difficult for a reclining person to reach the disengagement lever and exert sufficient force to free the axial support member.

The third mentioned device requires the reclinating user to exert sufficient force to move the plate member along the frictional surfaces. Continued use tends to wear the contact surfaces as well as score the plate member, thereby reducing the contact area and, thus, the frictional force maintaining the table surface at the desired inclination.

The present invention overcomes the disadvantages of the prior art by providing novel apparatus for inclining the planar surface of an adjustable table and which apparatus allows the inclination to be easily manipulated by a reclining person.

SUMMARY OF THE INVENTION

This invention is for an improved tilting mechanism for use with an adjustable table, having cooperating frictional elements which may be disengaged to allow the angle of inclination of the table to be changed. It includes a table having a horizontal support rotatably connected at one end to a vertical support. It preferably includes at least two cooperating members, each in the shape of a flat semi-circular strip. One member is preferably formed to include a bar member interconnecting the extremities of the semi-circular strip and is secured to the vertical upright with the bar member situated at the point of attachment of the horizontal support and further, with the arcuate portion extending downwardly and secured at a mid-point to the upright support. The remaining member is formed with the extremities bent 90° to form a pair of flanges. The flanges are interconnected to the table surface with the arcuate portion of the flanged member extending downward, with the member positioned to place it in contact with the first member. Frictional surfaces are formed on the adjacent surfaces of each member and cooperatively engage to inhibit rotational movement of the table surface about the horizontal axis. Further, it is preferable that the rotational connection of the horizontal support with the vertical support to be such as to allow upward rotational movement of the table surface about the connection to disengage the frictional surfaces of the cooperating members. The table surface may then be rotated about the horizontal support to a new angle of inclination. The table is then lowered to the horizontal position to bring the frictional elements into re-engagement and secure the table at the new angle of inclination.

Accordingly, it is a feature of the invention to provide an adjustable table which may conveniently be tilted by a person in a reclining or semi-reclining position.

Another feature of the present invention is the provision of an adjustable table which may conveniently be adjusted to any desired angle of inclination and includes means whereby heavy articles may be secured when the table surface is inclined.

Another feature is to provide such an adjustable table which includes additional storage space.

A further feature of the invention is the provision of an adjustable table which may conveniently be assembled and disassembled.

Still another feature is to provide an adjustable table having top and bottom table surfaces which may be utilized for different purposes.

A still further feature is the provision of a table including at least one caster on said table for providing movement of said table.

Another feature of the present invention is the provision of an adjustable table which is inexpensive to manufacture, simple in construction, easy to use and universal in its adaptability.

It is still a further feature of the invention to provide a table tilting mechanism using separate frictional elements which are engaged to secure the table at the desired angle of inclination and which are disengaged to change the angle of inclination of the table.

Other features and advantages of the present invention will become apparent to those skilled in the art as the disclosure is made in the following detailed description of the preferred embodiment of the invention as illustrated in the accompanying sheets of drawings in which:

FIG. 3 is enlarged prospective view of the upper, front portion of the device.

FIG. 4 is vertical sectional view through the junction between the table and the upright support.

FIG. 5 is a fragmentary, enlarged view, partly in cross-section, of the rotational connection between the horizontal support and the vertical support of the device.

DETAILED DESCRIPTION OF THE PREFERRED EMBODIMENT

Figure 1:
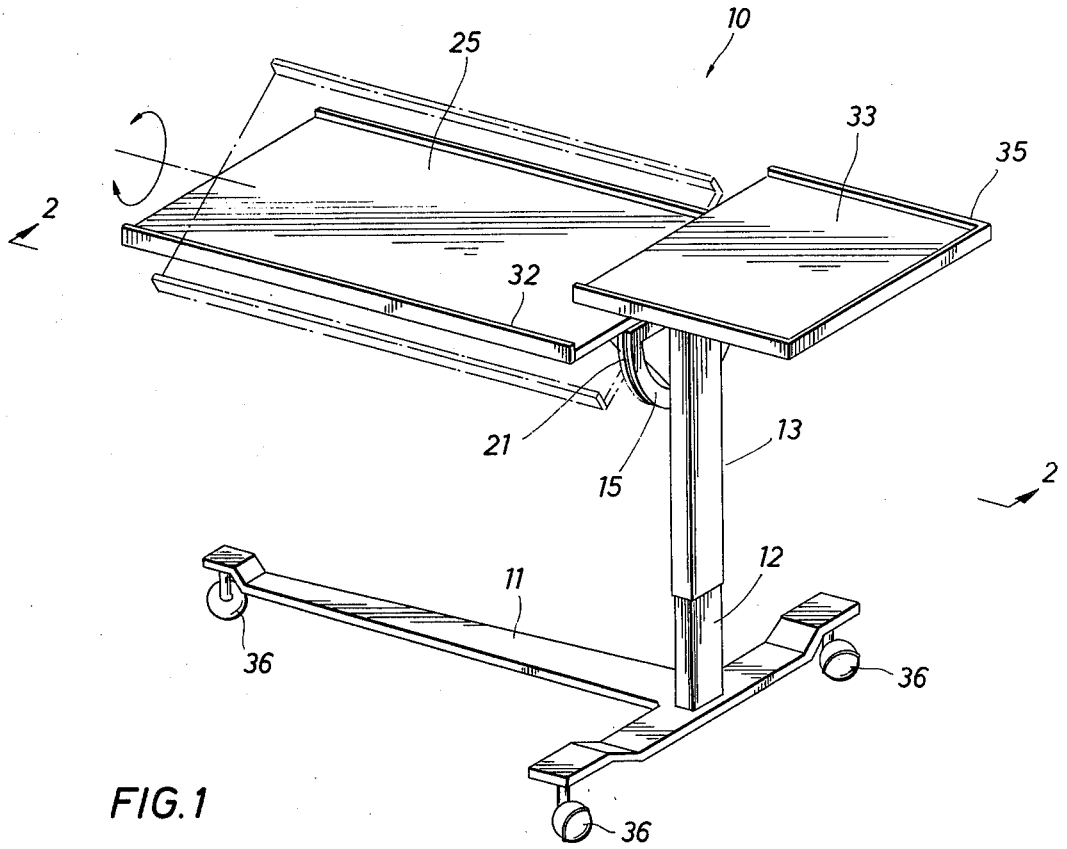
FIG. 1 illustrates a prospective view of a preferred embodiment of the invention.

Referring now to the drawings, there is shown in FIG. 1 an adjustable table 10 including an integrally formed, essentially T-shaped base 11. A vertical support 12 is secured in the approximate center of the top surface of the T-junction of base 11. Vertical support 12 includes a concentric outer sleeve 13 and an internal adjustment mechanism (not shown) having a lever 14 extending to the exterior of sleeve 13 for allowing manual disengagement of the mechanism to permit vertical adjustment of the support. Release of lever 14 re-engages the mechanism to secure the vertical support 12 at the preselected elevation.

Referring now to FIGS. 3 and 4, there is shown a cross bar 15 formed with an arcuate portion extending from one extremity to the remaining extremity. Cross bar 15 is fixedly attached at its mid-point adjacent the topmost extremity of sleeve 13 and with the arcuate portion extending downward. Further, there is shown a first friction element 16 formed on the surface of the arcuate portion of cross member 15 and opposite sleeve 13.

Also referring to FIG. 5, there is shown a housing 17 centrally affixed to cross member 15 and further defining a slot 18 formed through the housing and extending from a location normal to sleeve 13 upward about the housing to a location substantially parallel with sleeve 13. Housing 17 supports a cylindrical pin 19 having an opening 20 formed therethrough which is normal to the longitudinal axis of the pin 19.

Again referring to FIGS. 3 and 4, there is shown a U-shaped member 21 having flanges 22 formed at either extremity. U-member 21 conforms in size and shape to the size and shape of the arcuate portion of cross member 15. A second frictional element 24 is provided along the surface of U-member 21 opposite the flanges 22.

Figure 2:
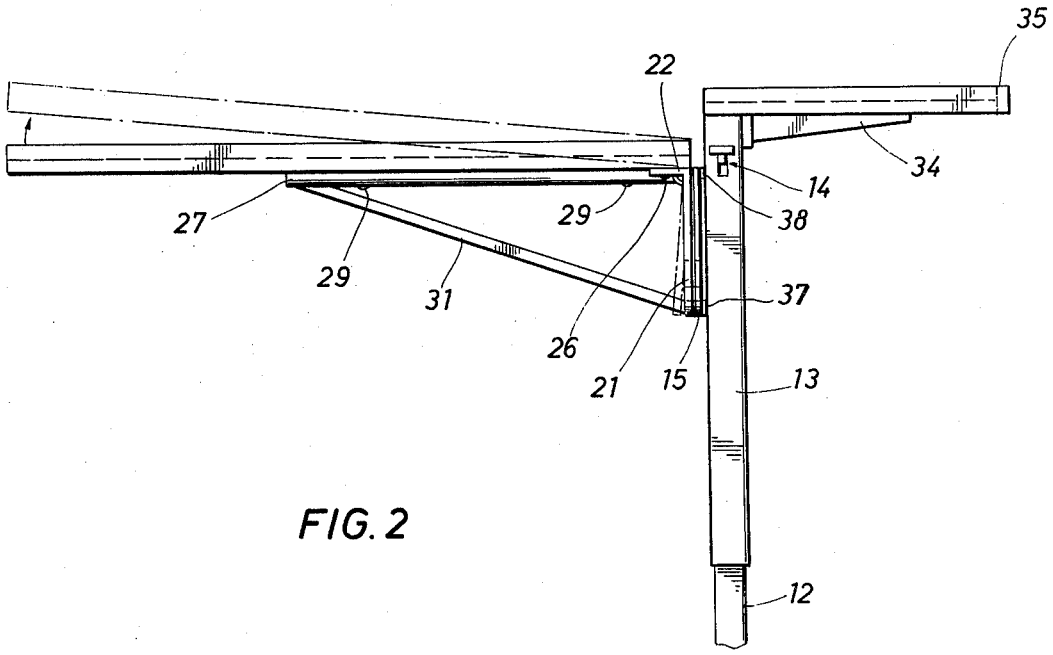
FIG. 2 is an elevational view of the upper portion of the device.

Referring now to FIGS. 2, 3 and 4, there is shown a table member 25 having U-member 21 affixed adjacent one extremity such as by wood screws 26 extending through openings 23 formed in flanges 22, and into the table member. When attached, U-member 21 is positioned normal to the surface of table member 25 with second frictional element 24 flush with the extremity of the table member 25.

Referring now to FIGS. 3 and 5, there is shown a horizontal support member 27 having a reduced diameter end portion 28 with a circumferential groove (not shown) formed adjacent the extremity. Support member 27 is attached to one surface of table 25 and extends along a line equidistant from and between flanges 22. Reduced end portion 28 extends beyond the extremity of table 25 into slot 18 and through opening 20.

A snap ring 30 is placed in the groove, securing the support member 27 to cross member 15. When thus secured, the second frictional member 24 of member 21 is positioned against and cooperates with the first frictional element 16 of cross member 15. Further, a tubular support member 31 is affixed at one extremity to U-member 21 and at the remaining extremity to horizontal support member 27.

Referring now to FIGS. 1 and 2, it may be seen that the weight of table 25 creates a downward force, which acts through flanges 22 and tubular support member 31 to force second frictional element 24 into engagement with first frictional element 16. As a result, table member 25 is securely held in position at the angle of inclination. If however, and now referring to FIG. 2, the free extremity of table 25 is moved vertically allowing reduced end portion 28 to move upward through slot 18, the second frictional element 24 is disengaged from first frictional element 16. When thus disengaged, table member 25 may be tilted about its longitudinal axis, with reduced end portion 28 rotating within opening 20. Allowing the extremity of table member 25 to move vertically downward again brings first and second frictional elements 16 and 24 into contact, thus securing table member 25 at the newly selected angle of inclination. The frictional elements 16 and 24 may constitute rubber or the like.

Preferably, cross bar 15 is spaced apart from sleeve 13 a preselected distance to provide clearance for the extremity of table member 25 adjacent sleeve 13 during the above-mentioned upward movement of the table member 25. Still referring to FIG. 2, a pair of spacers 37 and 38 or the like, is shown interposed between cross bar 15 and sleeve 13 at the points of attachment therebetween.

Referring now to FIGS. 1 through 4, the preferred embodiment herein depicted additionally shows a raised edge 32 which is provided to prevent articles placed on table member 25 from slipping off when the table member is inclined. Additionally, the preferred embodiment is shown with a second table member 33 mounted on the extremity of sleeve 13 and supported by table support member 34. Again, a raised edge 35 has been provided around second table member 33. Further, as a convenience for moving the adjustable table from place to place, casters 36 may be utilized in a conventional manner.

It is to be understood, of course, that the foregoing disclosure relates to only preferred embodiments of the invention and that it is intended to cover all of the changes and modifications of the example of the invention herein chosen for the purposes of the disclosure, which do not constitute departure from the spirit or scope of the invention.

What is claimed is:

1. An adjustable table having a base and an upright support member mounted on said base, comprising:

a horizontal support member rotatably connected at one extremity to said upright support member and extending outwardly therefrom, a first table portion secured along one surface to said horizontal support member, a first substantially vertically disposed frictional element secured to said upright support member, a second substantially vertically disposed frictional element secured to said first table portion and positioned to engage said first frictional element, and means cooperating with said horizontal support member for disengaging said first and second frictional elements.

2. The table described in claim 1, wherein said first and second frictional elements are substantially arcuately shaped.

3. The table described in claim 2, wherein each frictional element comprises an arcuately shaped section of metal bearing thereon a strip of frictional material.

4. The table described in claim 1, wherein said disengaging means includes structure to enable said first table portion to be both rotated about the axis of said horizontal support member and elevated at the free extremity of said first table portion.

5. The table described in claim 4, wherein said second frictional element is free to move upwardly and away from said first frictional element when the free extremity of said first table portion is elevated.

6. The table described in claim 1 and including a second table portion secured to said upright support member.

7. The table described in claim 6, wherein said second table portion is spaced above said first table portion.

8. The table described in claim 7 and including a plurality of casters attached to said base to enable said table to be moved from place to place.

9. The table described in claim 8, and including means for providing vertical adjustment of said upright support member.

10. The table described in claim 9, wherein said first table portion includes at least one lip means for preventing articles placed thereon from sliding therefrom.

* * * * *